US006179564B1

(12) United States Patent
Park

(10) Patent No.: US 6,179,564 B1
(45) Date of Patent: Jan. 30, 2001

(54) PORTABLE ELECTRIC FAN

(76) Inventor: Bae-sig Park, 425-1104 Kunyoung 1-cha Apt., 1047-1 Youngtong-dong, Paldal-gu, Suwon-city, Kyungki-do (KR)

( * ) Notice: Under 35 U.S.C. 154(b), the term of this patent shall be extended for 0 days.

(21) Appl. No.: 09/288,933

(22) Filed: Apr. 9, 1999

(30) Foreign Application Priority Data

Apr. 9, 1998 (KR) ..... 98-5553

(51) Int. Cl.[7] ..... B63H 1/00
(52) U.S. Cl. ..... 416/63; 416/146 R
(58) Field of Search ..... 416/63, 146 R, 416/244 R, 240, 189, 191, 170 R, 247 R, 224, 229 R, 231 R, 170 C, 244 C, 244 D; 422/124; 417/411

(56) References Cited

U.S. PATENT DOCUMENTS 5,304,035 * 4/1994 Carter ..... 416/63
5,851,106 * 12/1998 Steiner et al. ..... 416/63

FOREIGN PATENT DOCUMENTS 94-3857 6/1994 (KR) .
97-6232 7/1997 (KR) .

* cited by examiner

*Primary Examiner*—Edward K. Look
*Assistant Examiner*—Hermes Rodriguez
(74) *Attorney, Agent, or Firm*—Jiawei Huang; J.C. Patents

(57) ABSTRACT

A portable electric fan is provided. The portable electric fan includes a handle constructed of a case in the form of a hollow column, having one end through which one or more power supplying batteries are installed, a motor connected to the electrode of the battery for providing a rotational driving force, a fan which is installed on a rotating shaft of the motor and is rotatably driven, a protecting member enclosing the fan rotated by the motor, and a cord attached to some part of the protecting member. Therefore, the portable electric fan can be operated, while hanging around some part of a user's body such as the neck. Accordingly, it is possible to freely use both hands. Also, it is possible to safely produce air movement since a protecting member enclosing the fan is formed. Also, holes are formed for allowing the circulation of air between the case and the fan, thereby carrying perfume from a perfume pocket put into a space in the case to a user by the air movement caused during the rotation of the fan.

5 Claims, 12 Drawing Sheets

PORTABLE ELECTRIC FAN

BACKGROUND OF THE INVENTION

1. Field of the Invention

The present invention relates to a portable electric fan, and more particularly, to a portable electric fan which can be hung on some part of one's body such as the neck so that a user can freely use two arms.

2. Description of the Related Art

In general, a user holds the portable electric fan with their hands and brings the electric fan near an object to be cooled. Accordingly, breeze comes from the electric fan.

FIG. 1 is a schematic exploded perspective view of a conventional portable electric fan.

Referring to FIG. 1, a first locking unit 3 such as a screw, is formed on an outer circumference of one end of a case 1 in the form of a hollow column. A motor 6 is installed inside the other end of the case 1. The motor 6 includes a shaft 8 which protrudes to the outside through the middle of the end of the case. A fan 10 is installed on one end of the shaft 8. The fan 10 is formed of a flexible material such as rubber. A cover 15 is installed on the outer circumference of the first locking unit 3 to be separable. In the cover 15, a second locking unit 17 for locking onto the first locking unit 3 is formed on the inner circumference of a frame 16 in the form of a circular cup. An elastic member 18 for elastically biasing the battery 9 is installed on the inner surface of the bottom of the cover 15. One or more batteries 9 are installed inside the case 1 between the motor 6 and the cover 15.

The operation of the conventional portable electric fan having the above structure is as follows.

The cover 15 of the portable electric fan is rotated slightly in one direction with the portable electric fan in the hands. At this time, when an elastic member 18 pushes the battery 9 toward the motor 6, the power of the battery 9 is transmitted to the motor 6. It is possible to provide the power of the battery 9 to the motor 6 by operating a power source switch (not shown) instead of rotating the cover 15. When the shaft 8 of the motor 6 rotates in one direction, the fan 10 rotates in one direction and air is moved from the rear of the fan 10 to the front of the fan creating a breeze. Therefore, a user who feels hot is cooled by the air which moves past and absorbs heat.

The conventional portable fan having the above structure is held by one or more hands when it is operated in order to cool the user. Therefore, it is difficult to freely use both hands when the user is cooled by the portable fan. Also, when the fan is formed of a hard material, a safety problem occurs during rotation. When the fan is formed of a flexible material such as rubber, the fan temporarily stops when it contacts the body. Accordingly, the movement of air stops and the function of cooling the user deteriorates.

SUMMARY OF THE INVENTION

To solve the above problem, it is an objective of the present invention to provide a portable electric fan which can be hung on some part of the body such as the neck of a user when the user is cooled and which is enclosed by a protecting member in order to allow the fan to rotate safely and to make the movement of air large.

Accordingly, to achieve the above objective, there is provided a portable electric fan, comprising a handle constructed of a case in the form of a hollow column, having one end through which one or more power supplying batteries are installed, a motor connected to the electrode of the battery for providing a rotational driving force, a fan which is installed on a rotating shaft of the motor and is rotatably driven, a protecting member enclosing the fan rotated by the motor, and a cord attached to some part of the protecting member.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENTS

Hereinafter, preferred embodiments of a portable electric fan according to the present invention will be described in detail with reference to the attached drawings.

Figure 1:
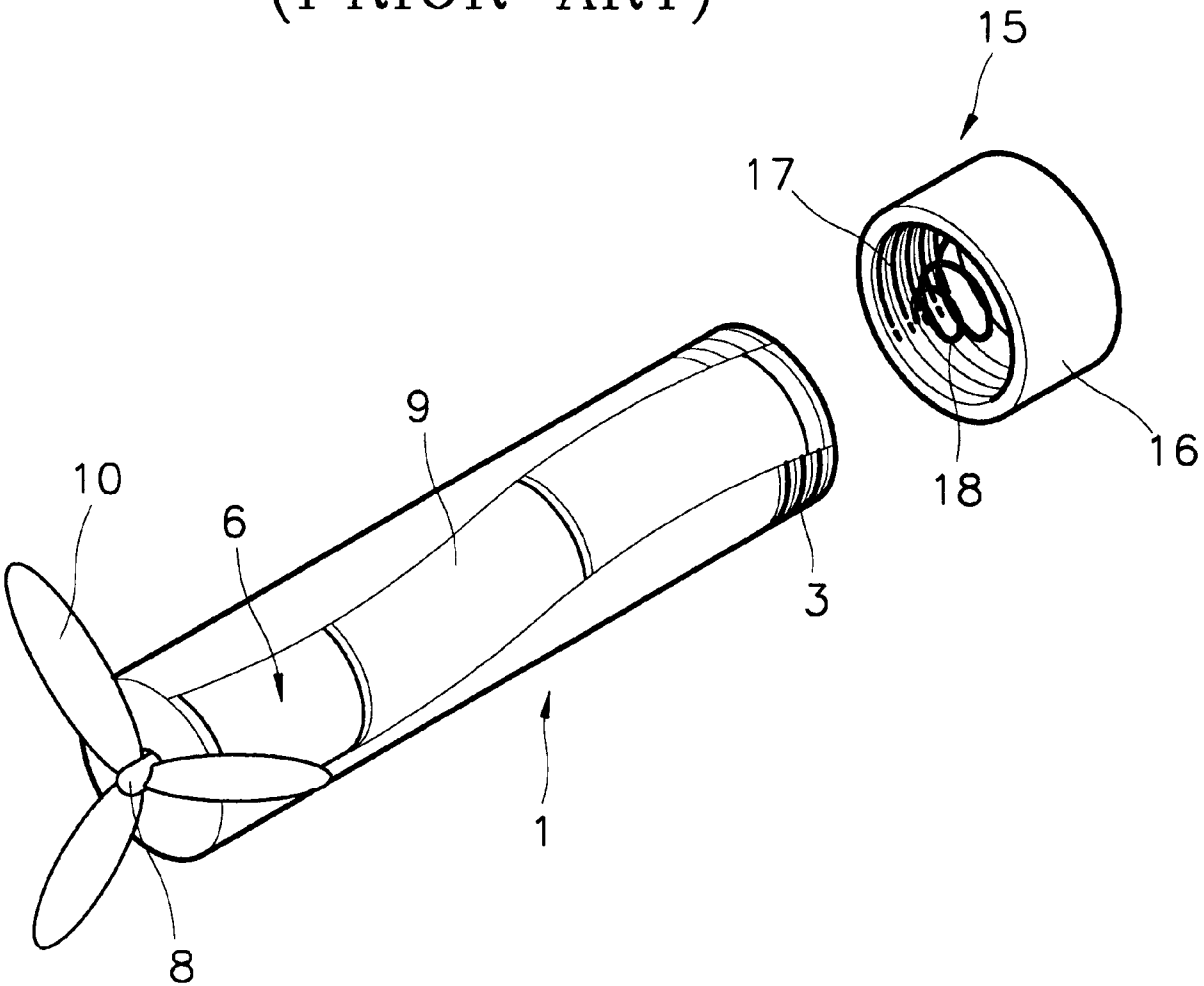
FIG.1 (PRIOR ART)
FIG. 1 is an exploded perspective view of a conventional portable electric fan.
Figure 2:
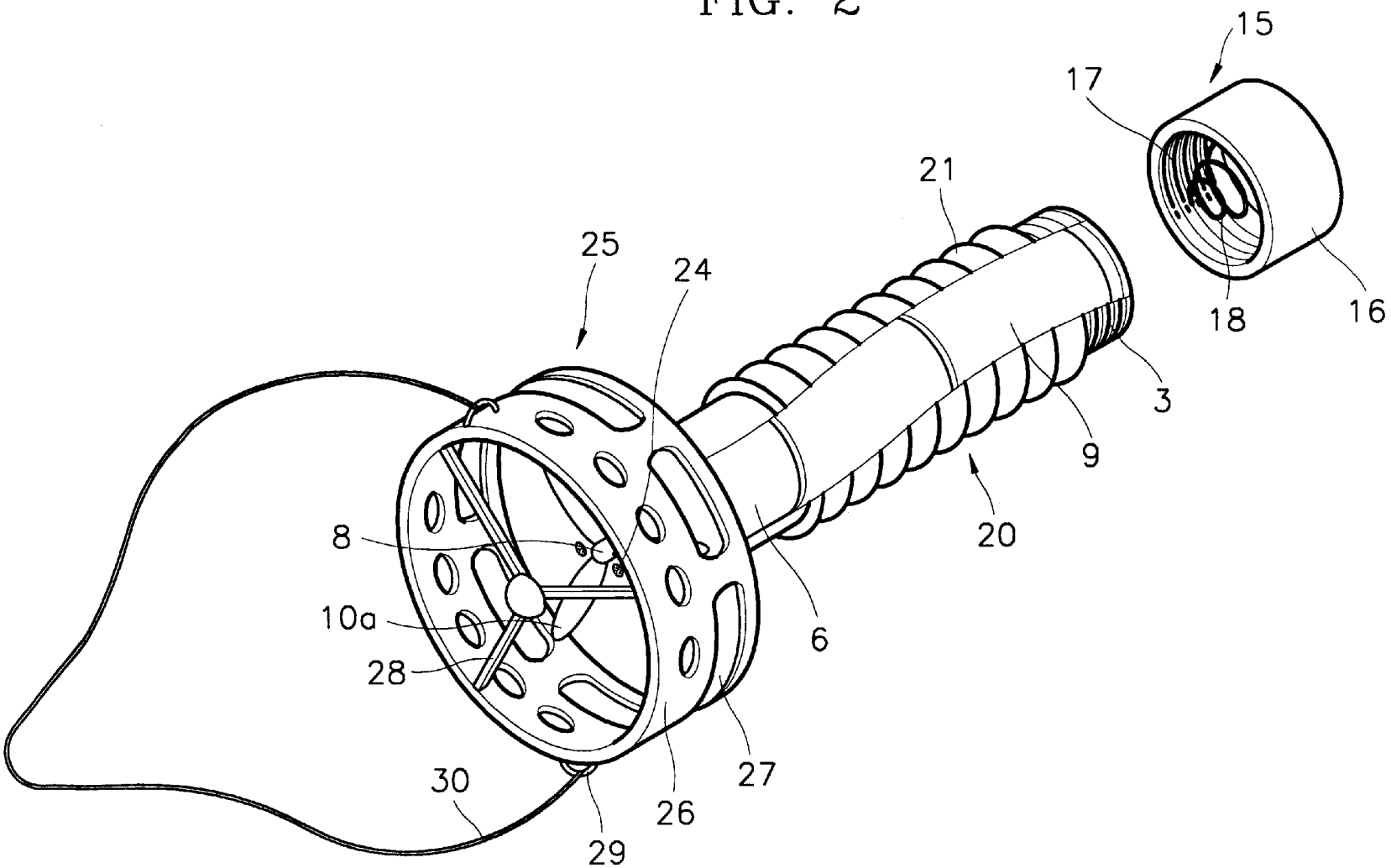
FIG. 2 is an exploded perspective view of a portable electric fan according to a first embodiment of the present invention.

FIG. 2 is a schematic perspective view of a portable electric fan according to a first embodiment of the present invention.

Referring to FIG. 2, in the portable electric fan according to the first embodiment of the present invention, a motor 6 for providing a rotational driving force is installed inside one end of a case 20 in the form of a hollow column. A first locking unit 3 in the form of a male screw is formed on the outer circumference of the other end of the case 20. A cover 15 is installed to be separable on the outer circumference of the first locking unit 3. In the cover 15, a second locking unit 17 for locking onto the first locking unit 3 is formed on the inner circumference of a frame 16 in the form of a circular cup. An elastic member 18 for elastically biasing the battery 9 is installed on the inner surface of the bottom of the cover 15. The battery 9 for supplying power is installed inside the case 20. A slip preventing member 21 for preventing one's hands from slipping is installed on the outer circumference of the case. The motor 6 includes the shaft 8 inside thereof. A fan 10*a* is installed on one end of the shaft 8. The fan 10*a* is formed of a hard material such as plastic or a soft material such as a sponge. A protecting member 25 for enclosing the fan 10*a* such that the fan is rotatable, is installed between one surface of the motor 6 and the fan 10*a*. In the protecting member 25, a plurality of girders 28 which prevent alien objects from coming in and operate as a protector during the rotation of the fan 10*a*, are installed in the open end of a body 26 in the form of a circular cup and which has one or more slots 27 on the outer circumference. Three girders are installed in FIG. 2. However, more than three girders can be installed so as to facilitate the circulation of air. Two rings 29 are installed in some part of the outer circumference of the body 26. A cord 30 which is long enough to hang the electric fan around the neck of the user is attached to the rings 29. Also, reference numeral 24 denotes holes for allowing the circulation of air between the case and the fan. When a perfume pocket 34 as shown in FIG. 5Cis put into a space left after inserting the battery 9 into the case 20, perfume from the perfume pocket is carried to the user via the moving air since the air blows when the fan 10*a* rotates. The holes 24 are formed on the cover of the motor 6 and the bottom of the cover 15.

The operation of the portable electric fan according to the first embodiment of the present invention having the above structure will be described as follows with reference to FIG. 2.

The user holds a slip preventing member 21 with one hand and rotates the cover 15 in a direction with the hand holding the slip preventing member 21 or the other hand such that the cover 15 moves toward the battery 9. At this time, the power of the battery 9 is provided to the motor 6, rotating the shaft 8. The fan 10*a* rotates according to the rotation of the shaft 8. The air outside the protecting member 25 is carried to the inside of the protecting member 25 through the plurality of slots 27. The air is moved from the rear of the rotating fan 10*a* to the front of the fan (i.e., from the right side of the drawing to the left side of the drawing). At this time, the user can freely use both hands, hanging the cord 30 around some part of the body such as the neck or a shoulder.

Figure 3:
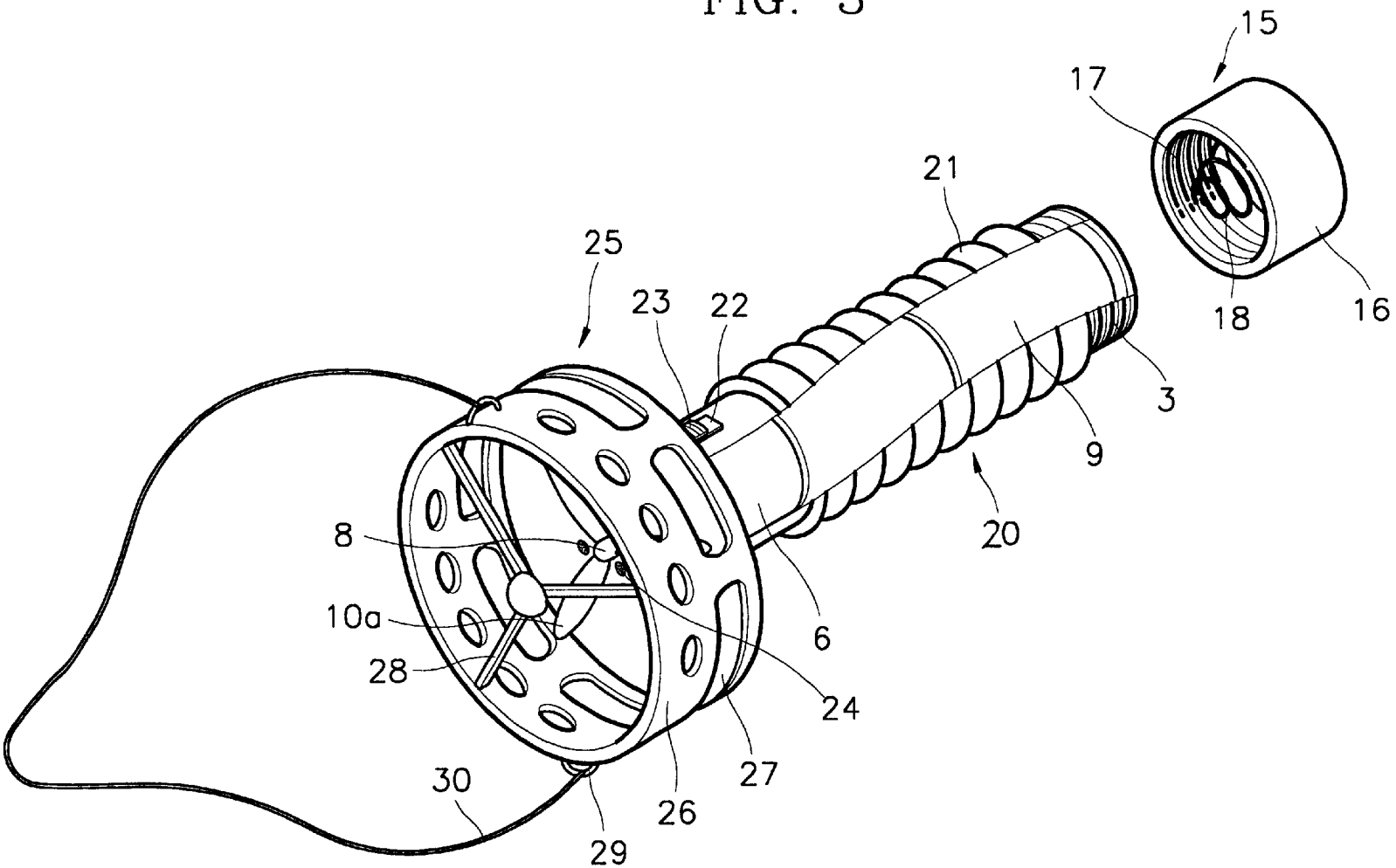
FIG. 3 is a schematic exploded perspective view of a portable electric fan according to a second embodiment of the present invention.

FIG. 3 is a schematic exploded perspective view of a portable electric fan according to a second embodiment of the present invention.

Referring to FIG. 3, the portable electric fan according to the second embodiment of the present invention includes a groove 22 on the outer circumference of one end of the case 20 in the form of a hollow column described in the first embodiment of the present invention. A switch 23 for turning the power provided from the battery 9 to the motor 6 on or off is installed in the groove 22. The remaining structure is the same as that of the first embodiment.

The operation of the portable electric fan according to the second embodiment of the present invention will be described as follows with reference to FIG. 3.

The user holds the slip preventing member 21 with one hand and turns on the switch 23 with the hand holding the slip preventing member 21 or the other hand. At this time, the power of the battery 9 is provided to the motor 6, thus rotating the shaft 8. The fan 10*a* rotates according to the rotation of the shaft 8. The remaining operation is the same as that of the first embodiment of the present invention. In the portable electric fan according to the second embodiment of the present invention, it is possible to easily turn the power supplied to motor 6 on and off.

Figure 4:
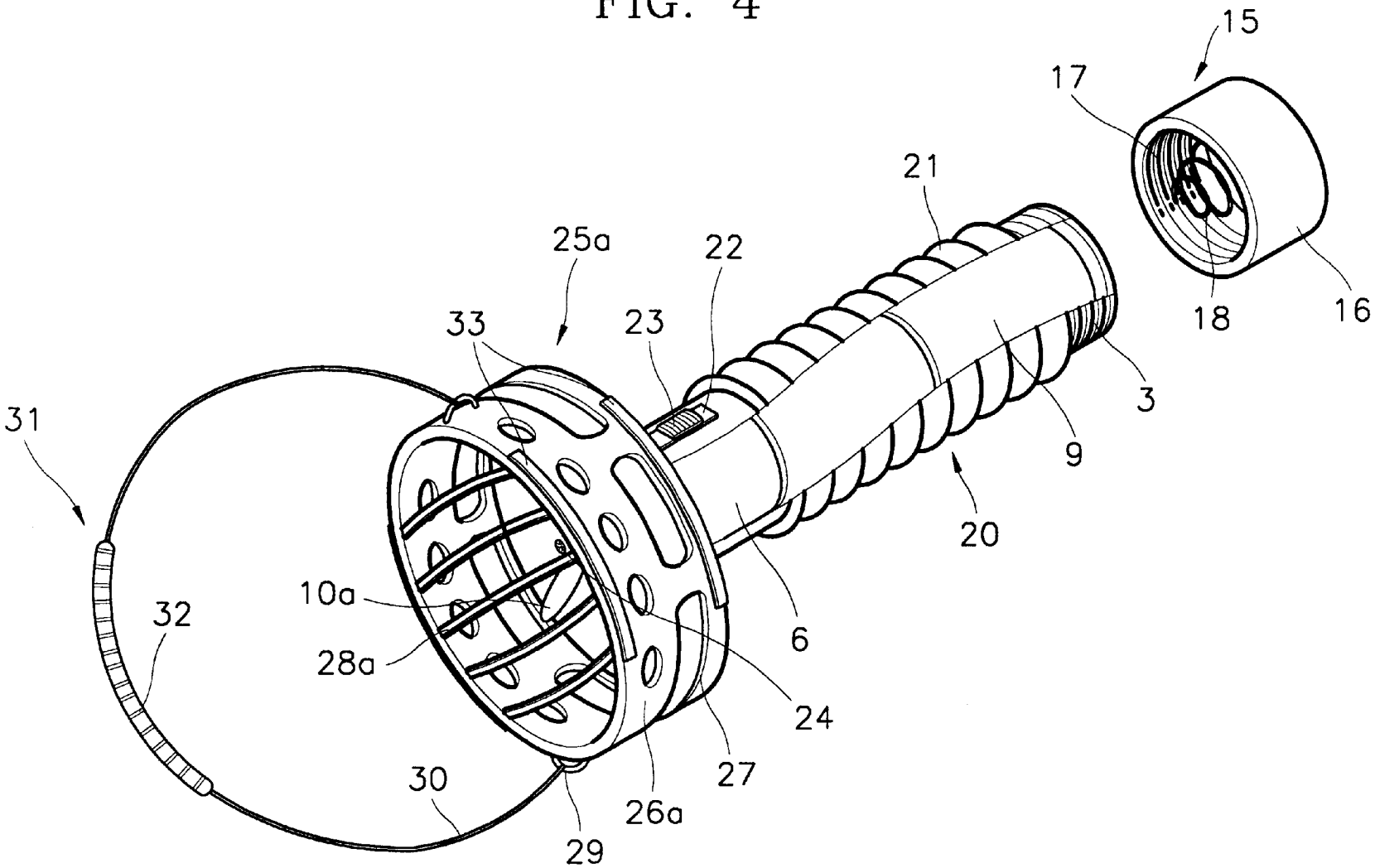
FIG. 4 is a schematic exploded perspective view of a portable electric fan according to a third embodiment of the present invention.

FIG. 4 is a schematic exploded perspective view of a portable electric fan according to a third embodiment of the present invention.

Referring to FIG. 4, in the portable electric fan according to the third embodiment of the present invention, the motor 6 for providing a rotational driving force is installed inside one end of the case 20 in the form of the hollow column. A groove 22 is formed on the outer circumference of one end of the case 20. A first locking unit 3 in the form of a male screw is formed on the outer circumference of the other end. A separable cover 15 is installed on the outer circumference of the first locking unit 3. In the cover 15, a second locking unit 17 for locking to the first locking unit 3 is formed on the inner circumference of a frame 16 in the form of a circular cup. An elastic member 18 for elastically biasing the battery 9 is installed on the inner surface of the bottom of the cover 15. The battery 9 for providing power is installed inside the case 20. A slip preventing member 21 for preventing one's hands from slipping is installed on the outer circumference of the case 20. The switch 23 for turning the power provided from the battery 9 to the motor 6 on or off is installed in the groove 22. The motor 6 includes a shaft (not shown). The fan 10*a* is installed on one end of the shaft. The fan 10*a* is formed of a hard material such as plastic or a soft material such as sponge. A protecting member 25*a* enclosing the fan 10*a* such that the fan 10*a* is rotatable, is installed between one surface of the motor 6 and the fan 10*a*. In the protecting member 25*a*, a plurality of girders 28*a* which prevent alien objects from coming in and operate as a protector during the rotation of the fan 10*a* are installed in the open end of a body 26*a* in the form of a circular cup. One or more slots 27 are formed on the outer circumference of the body 26*a*. A plurality of buffering members 33 for absorbing shock from the outside are formed on the outer circumference of the protecting member 25*a*. Two rings 29 are installed on some part of the outer circumference of the body 26*a*. A cord 30 which is long enough to hang the electric fan around the neck of a user is attached to the rings 29. A slide preventing member 31 for preventing the cord 30 from sliding is installed at the center of the cord 30. A plurality of protrusions 32 are included along the slide preventing member 31.

The operation of the portable electric fan according to the third embodiment of the present invention having the above structure will be described as follows with reference to FIG. 4.

The user holds the slip preventing member 21 with one hand and turns on the switch 23 with the hand holding the slip preventing member 21 or the other hand. At this time, the power of the battery 9 is provided to the motor 6, thus rotating the shaft. The fan 10*a* rotates according to the rotation of the shaft. The remaining operation is the same as that of the first embodiment of the present invention. When the portable electric fan according to the third embodiment of the present invention is hung around some part of a user's body such as the neck, the line 30 is prevented from moving by the slip preventing member 31. Also, since the protecting member 25*a* is elliptical, it is possible to prevent the protecting member from contacting the user and being freely rotated. The buffering member 33 relaxes the shock transmitted to the body or the user when the protecting member 25*a* collides with an outer object or the user.

Figure 5A:
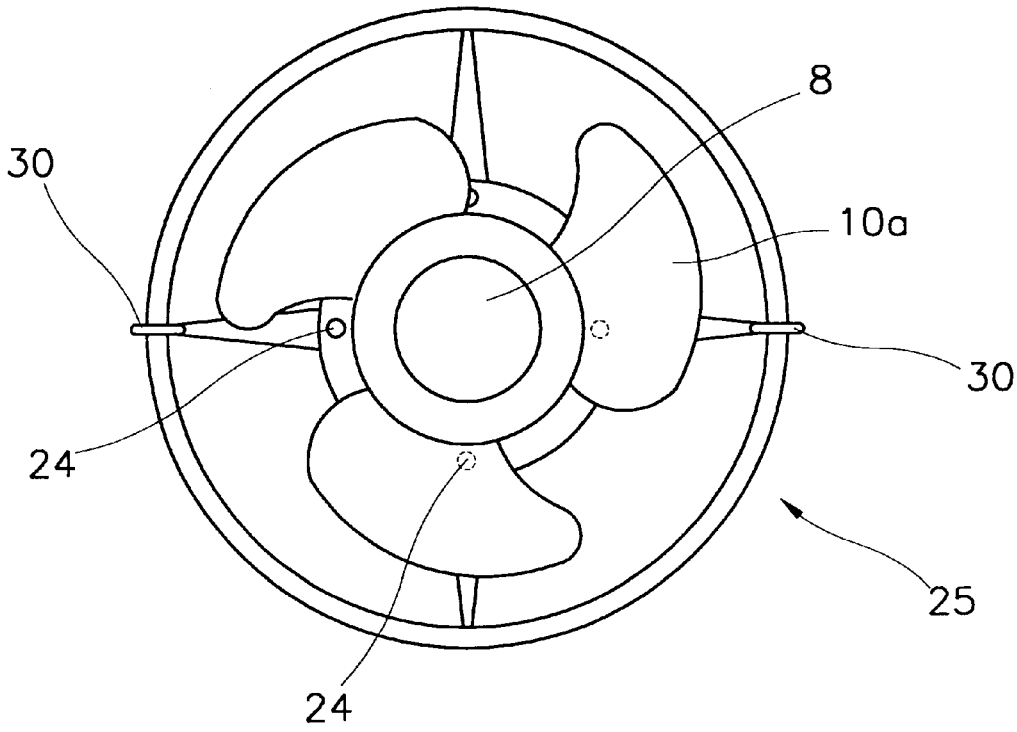
FIGS. 5A through 5C are respectively a plan view, a side view, and a bottom view of a portable electric fan according to a fourth embodiment of the present invention.
Figure 5B:
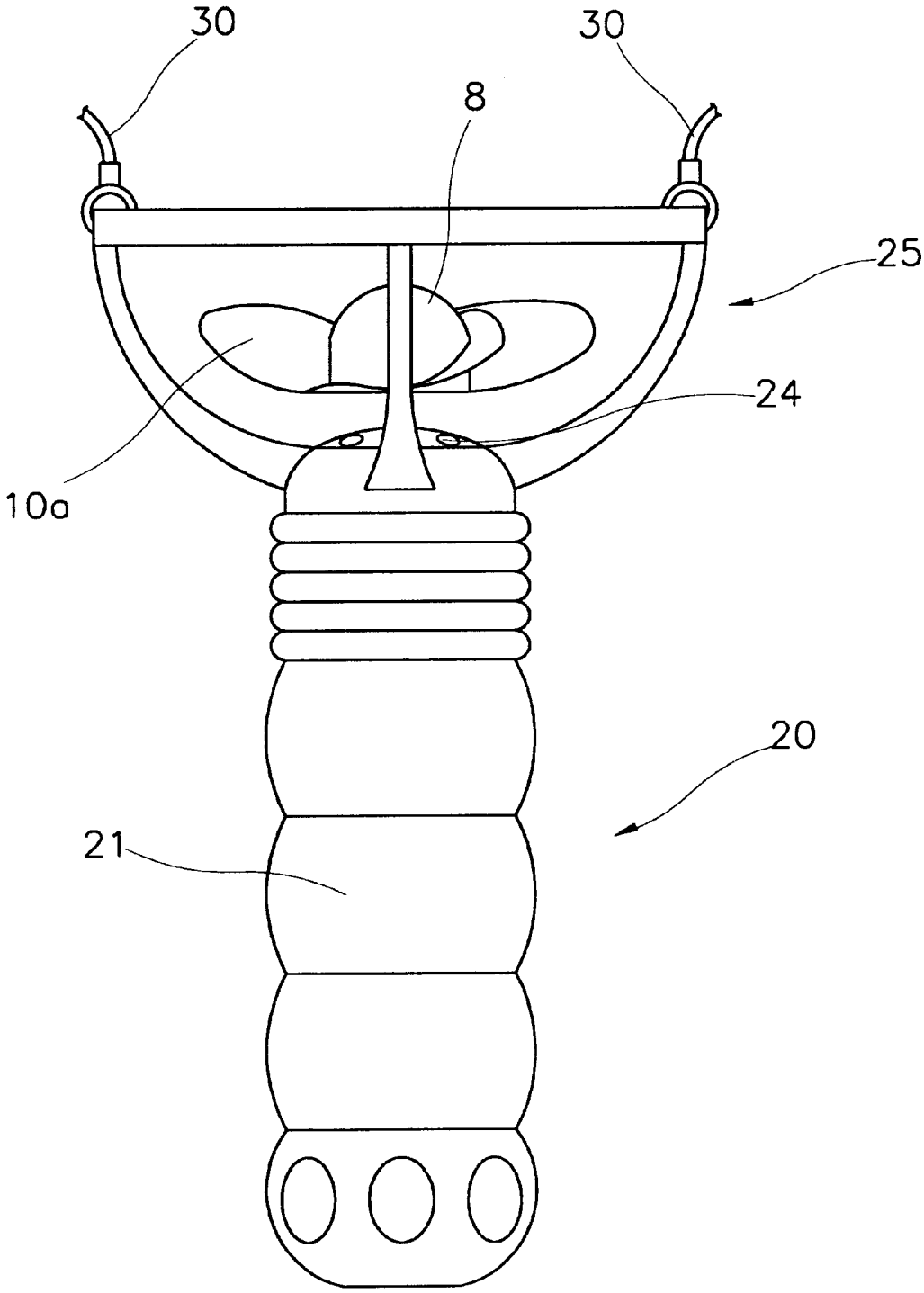
Figure 5C:
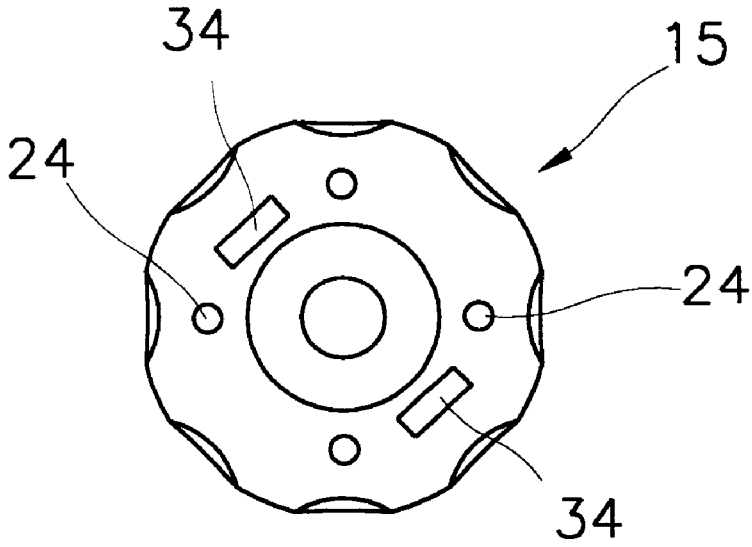
Figure 6A:
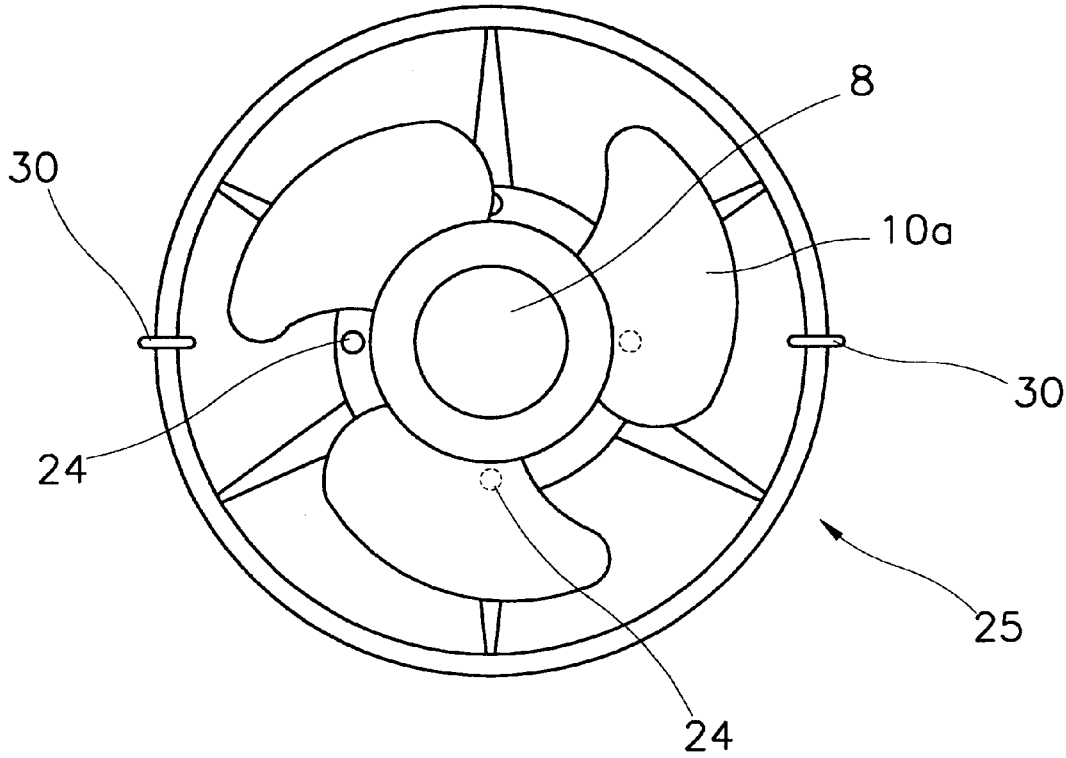
FIGS. 6A through 6C are respectively a plan view, a side view, and a bottom view of a portable electric fan according to a fifth embodiment of the present invention.
Figure 6B:
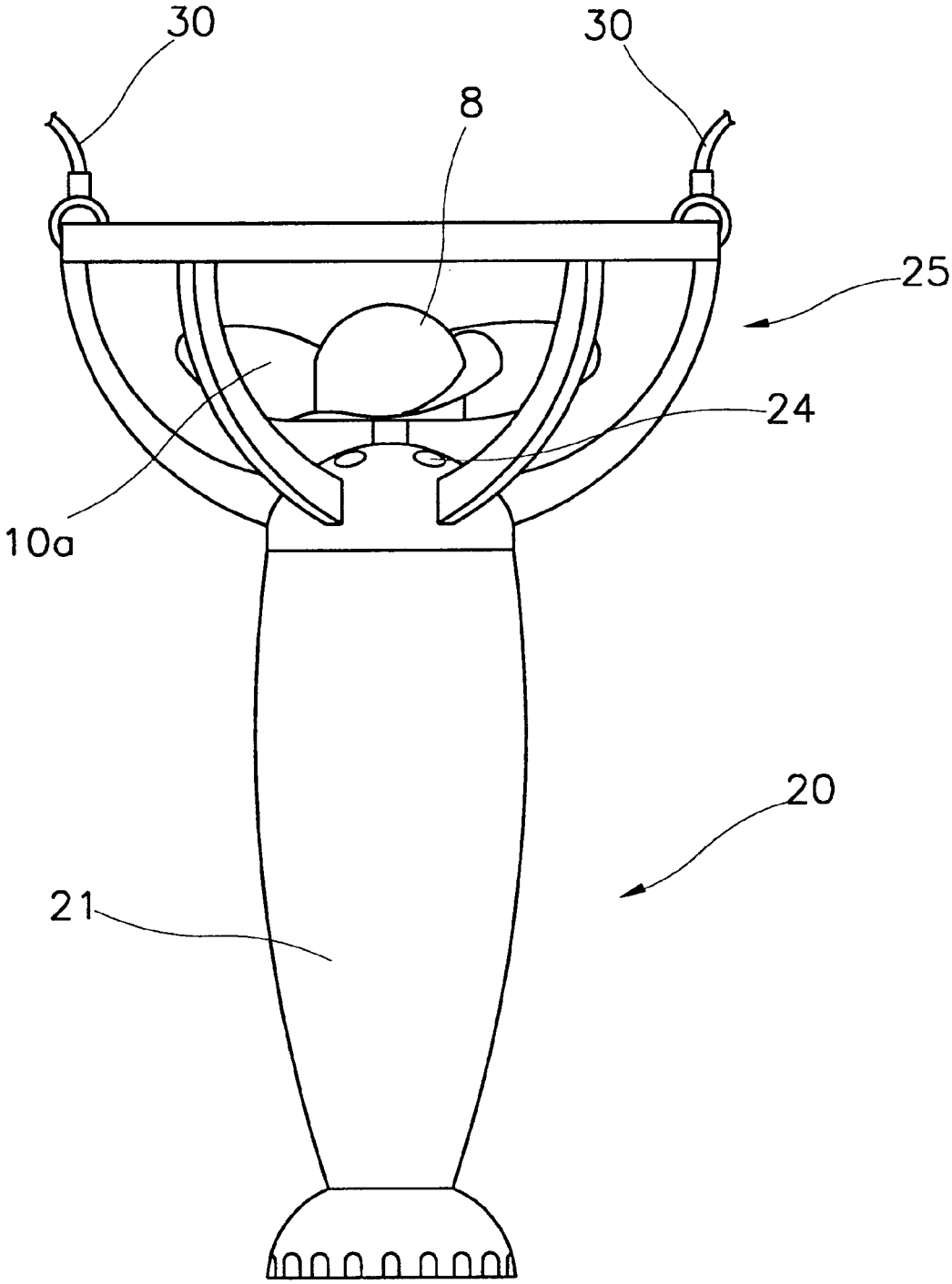
Figure 6C:
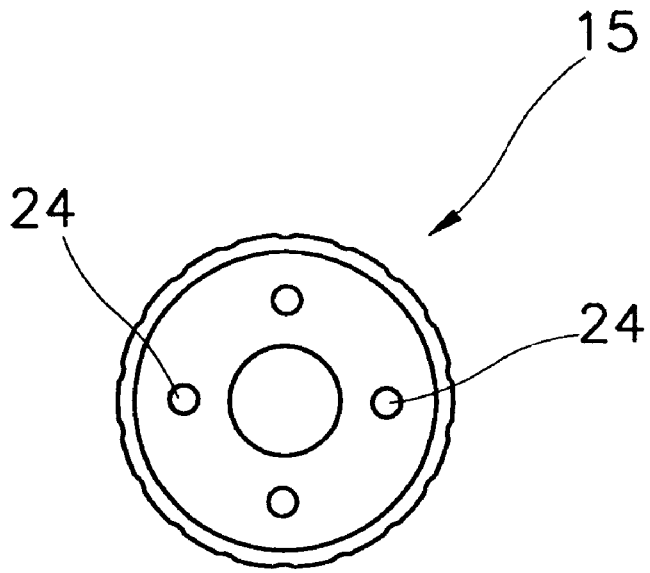

FIGS. 5A through 5C are respectively a plan view, a side view, and a bottom view of a portable electric fan according to a fourth embodiment of the present invention. FIGS. 6A through 6C are respectively a plan view, a side view, and a bottom view of a portable electric fan according to a fifth embodiment of the present invention. As shown in the drawings, the portable electric fans according to the present embodiments operate in the same way as the portable electric fan shown in FIG. 2. However, the shapes of the protecting member 25 and the handle 21 are different. In the present embodiments, the plurality of girders 28 which operate as protectors during the rotation of the fan need not be located in the open end of the protecting member 25 since the fan 10*a* can be formed of a soft material such as sponge. It is possible to employ girders which operate as protectors as shown in FIG. 2. It is known to anyone skilled in the art that the shape of the protecting member 25 in the form of a cup enclosing the fan is variable. Also, in the present embodiments, the handle 21 may be in the form of the body of a silkworm as shown in FIG. 5B and in the form of a rocket or a bomb as shown in FIG. 6B.

Figure 7A:
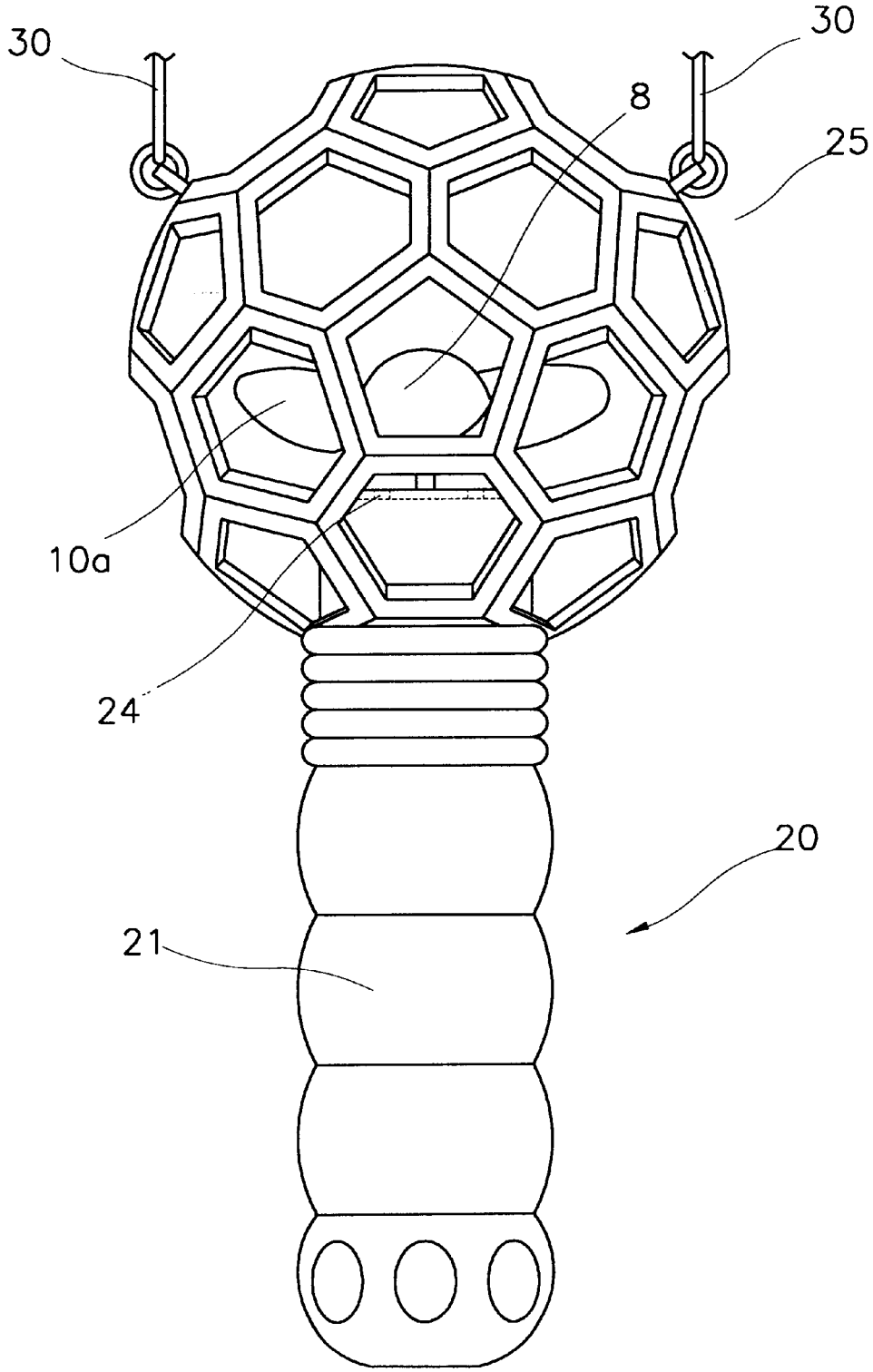
FIGS. 7A and 7B are a side view and a bottom view of a portable electric fan according to a sixth embodiment of the present invention.
Figure 7B:
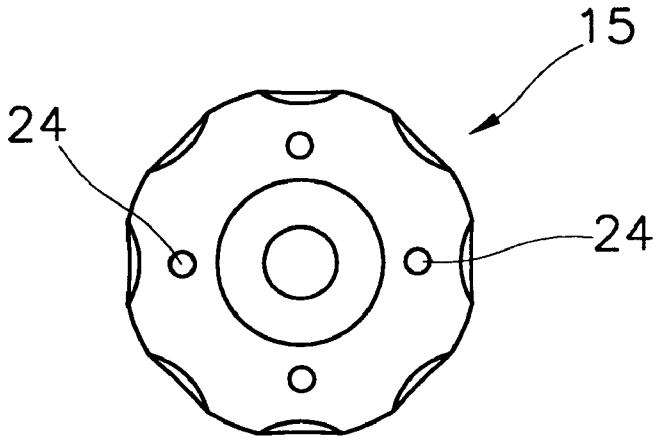

FIGS. 7A and 7B are respectively a side view and a bottom view of a portable electric fan according to a sixth embodiment of the present invention. As shown in FIGS. 7A and 7B, the portable electric fan according to the sixth embodiment of the present invention is functionally the same as the portable electric fan shown in FIG. 5B. However, the shapes of the protecting members 25 are different. In the sixth embodiment of the present invention, the protecting member 25 is in the form of a soccer ball completely surrounding the fan 10*a*. A pentagonal or hexagonal aperture is formed on the surface of the protecting member, thus facilitating the circulation of the air by the electric fan.

The structure and operation of the fourth through sixth embodiments are the same as those of the portable electric fan of FIG. 2 excluding the above-mentioned differences. Therefore, a detailed description thereof will be omitted.

As mentioned above, the portable electric fan according to the present invention can be operated while hanging on some part of a user's body such as the neck. Accordingly, it is possible to freely use both hands. Also, it is possible to safely circulate air since the protecting member surrounding the fan is formed. Also, air circulates between the case and the fan, and perfume from a perfume pocket put into a space in the case is carried to the user when the fan rotates.

What is claimed is:

1. A portable electric fan, comprising:

a handle comprised of a case in the form of a hollow column, having one end through which one or more power supplying batteries are installed;

a motor installed at the other end of the case and connected to the electrode of the battery for providing a rotational driving force;

a fan which is installed on a rotating shaft of the motor and is rotatably driven, and formed of sponge;

a protecting member enclosing the fan rotated by the motor, wherein said protecting member comprises: a body in the form of a cup which is completely open in a direction away from the case and the fan so that the air movement caused by the fan is directed away from the case and the fan; and rings installed on some part of the outer circumference of the body; and a cord attached to said rings.

2. A portable electric fan, comprising:

a handle comprised of a case in the form of a hollow column, having one end through which one or more power supplying batteries are installed;

a motor installed at the other end of the case and connected to the electrode of the battery for providing a rotational driving force;

a fan which is installed on a rotating shaft of the motor and is rotatably driven, and formed of sponge;

a cup-shaped protecting member enclosing the fan rotated by the motor, wherein said protecting member comprises: a ball shaped body having at least one aperture on the outer circumference; and a plurality of rings installed on some part of the body; and a cord attached to said rings.

3. A portable electric fan, comprising:

a handle comprised of a case in the form of a hollow column, having one end through which one or more power supplying batteries are installed;

a motor installed at the other end of the case and connected to the electrode of a battery for providing a rotational driving force;

a fan which is installed on a rotating shaft of the motor and is rotatably driven, and formed of hard plastic;

a protecting member enclosing the fan rotated by the motor, wherein said protecting member comprises: a cup-shaped protecting body enclosing the fan; a plurality of girders installed in an open end of the body, which prevent alien objects from coming in and which operate as protectors during the rotation of the fan; and rings installed on some part of the outer circumference of the body; and a cord attached to said rings.

4. A portable electric fan, comprising:

a handle comprised of a case in the form of a hollow column, having one end through which one or more power supplying batteries are installed;

a motor installed at the other end of the case and connected to the electrode of the battery for providing a rotational driving force;

a fan which is installed on a rotating shaft of the motor and is rotatably driven, and formed of sponge;

a protecting member enclosing the fan rotated by the motor, wherein said protecting member comprises a body in the form of a cup which is completely opened so that the air movement caused by the fan is directed away from the fan, and rings installed on some part of the outer circumference of the body;

a cord attached to said rings; and holes for allowing the circulation of air between the case and the fan, wherein, when a perfume pocket is put into a space left after inserting the battery into the case, the perfume from the perfume pocket is carried to a user by the air movement caused during the rotation of the fan, and wherein said holes are formed on a cover of the motor and a bottom cover of the cases.

5. A portable electric fan, comprising:

a handle in the form of a hollow column, said handle having a first end through which one or more power supplying batteries are installed;

a first cover for covering the first end of the handle;

a motor installed at a second end of the handle and connected to the electrode of the battery for providing a rotational driving force, the motor having a second cover;

a fan which is installed on a rotating shaft of the motor and is rotatably driven, wherein the fan is separated from the motor and the handle by the second cover;

a protecting member enclosing the fan;

a cord attached to the protecting member; and holes formed on the first cover and the second cover for allowing the circulation of air between the handle and the fan.

* * * * *